US006877852B2

(12) United States Patent
Hay et al.

(10) Patent No.: US 6,877,852 B2
(45) Date of Patent: Apr. 12, 2005

(54) INK JET PRINTING SYSTEMS AND RELATED METHODS

(75) Inventors: Mark A. Hay, Poway, CA (US); Michael Klausbruckner, San Diego, CA (US); Josep Maria Serra, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/205,800

(22) Filed: Jul. 26, 2002

(65) Prior Publication Data

US 2004/0017453 A1 Jan. 29, 2004

(51) Int. Cl.[7] ..... B41J 2/01

(52) U.S. Cl. ..... 347/102; 101/424.1; 219/216; 34/60

(58) Field of Search ..... 347/102, 108, 347/103, 26; 101/424.1; 219/216; 34/60

(56) References Cited

U.S. PATENT DOCUMENTS 4,866,593 A * 9/1989 Miura et al. ..... 346/107
5,710,586 A 1/1998 Esplin et al. ..... 347/103
5,864,352 A * 1/1999 Aoki et al. ..... 347/102
5,923,343 A 7/1999 Brosseau et al. ..... 347/4
5,949,462 A 9/1999 Esplin et al. ..... 347/108
5,956,554 A 9/1999 Yanashima et al. ..... 399/328
6,240,265 B1 5/2001 Noh ..... 399/92
6,390,618 B1 5/2002 Wotton et al.
6,439,712 B1 * 8/2002 Mizutani et al. ..... 347/102

FOREIGN PATENT DOCUMENTS

EP 0 429 818 6/1991
JP 08 224871 9/1996

* cited by examiner

*Primary Examiner*—Stephen D. Meier
*Assistant Examiner*—Ly T Tran

(57) ABSTRACT

In accordance with one embodiment, a system comprises a print head assembly comprising a plurality of ink-ejecting nozzles and a drying station downstream of the print head assembly and configured to produce and emit air proximate a print media. A deflector is mounted between the print head assembly and the drying station and is configured to deflect an amount of the air that is produced by the drying station.

47 Claims, 4 Drawing Sheets

INK JET PRINTING SYSTEMS AND RELATED METHODS

BACKGROUND

Ink jet printing systems typically operate by applying ink from print head nozzles onto a print media such as paper. The wetted print media is then typically moved to a drying station that contains one or more heaters that are positioned to heat the ink and hence facilitate its drying on the print media. The heaters typically consist of a number of bulbs that produce the drying heat that is utilized to dry the ink on the page. To facilitate circulation of the heat within the drying station, a fan is typically used to ensure that the heat is moved or otherwise circulated within the drying station.

As an example, consider FIG. 1 which schematically shows an exemplary ink jet printing system generally at 100. System 100 typically includes a print head assembly 102 which can include a number of different nozzles for selectively applying ink to a print media such as a piece of paper 103. Paper is advanced into the region in which the assembly resides, has ink applied to it, and is moved into a drying station generally indicated at 104. The drying station typically includes a heater assembly 106 that includes one or more heat sources, and a fan 108 to direct heated air in the direction of the paper to facilitate the ink drying process.

One of the problems that systems, such as system 100, can experience is that the air that is circulated to facilitate the drying process can undesirably move into the region occupied by the print head assembly, as indicated by the arrows. When this happens, ink that is being expelled from the nozzles can be dispersed by the air and provided into an aerosol state. When this occurs, the ink can otherwise be deposited onto portions of the print media that are not intended to carry the deposited ink. Hence, the print quality is undesirably decreased. Additionally, another problem that can be caused by this undesired air circulation is that the performance of the print head assembly can be adversely impacted. Specifically, the print head assembly, also termed "TIJ pens", has temperature ranges within which its operation is desired to fall. When the print head assembly operates outside of this temperature range, as for example, operating at elevated temperatures, the overall performance and lifetime of the print head assembly can be undesirably reduced.

SUMMARY

In accordance with one embodiment, a system comprises a print head assembly comprising a plurality of ink-ejecting nozzles and a drying station downstream of the print head assembly and configured to produce and emit air proximate a print media. A deflector is mounted between the print head assembly and the drying station and is configured to deflect an amount of the air that is produced by the drying station.

In accordance with another embodiment, a method comprises emitting air from a primary drying station within an ink jet printer, creating an intermediate drying station by collecting at least some of the emitted air using a deflector that is interposed between the primary drying station and a print head assembly of the ink jet printer, moving a wetted print media within the intermediate drying station, and moving the print media within the primary drying station.

DETAILED DESCRIPTION

Overview

In accordance with various embodiments, ink jet printing systems are provided with a deflector that is mounted between the printer's print head assembly and its drying station. The deflector functions to deflect a desirable amount of the air, for example, the heated air, that is produced at the drying station from reaching the print head assembly. Accordingly, the deflector helps to reduce ink aerosol that is produced by air that migrates into the region of the printer occupied by the print head assembly. Additionally, deflection of the heated air creates an intermediate drying region or station, outside of the drying station, that is encountered by a wetted print media on its way to the drying station. The intermediate drying station can facilitate the ink drying process. Additionally, advantages are achieved in the area of print head performance and lifetime by deflecting a desirable amount of the air that previously adversely impacted print head performance. Other advantages will be apparent to those of skill in the art.

Exemplary Ink Jet Printer

Figure 2:
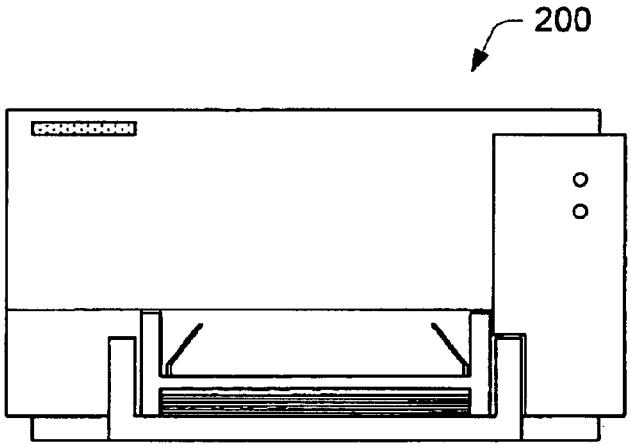
FIG. 2 illustrates an exemplary ink jet printer that can be utilized to implement one or more embodiments.

FIG. 2 shows an exemplary ink jet printer 200 that can be utilized to implement the described embodiments. Inkjet printer 200 can be capable of printing in black-and-white and in color. It should be appreciated that the described embodiments can be implemented in connection with other ink jet printing devices such as facsimile machines, photocopiers, scanners, and the like.

Figure 3:
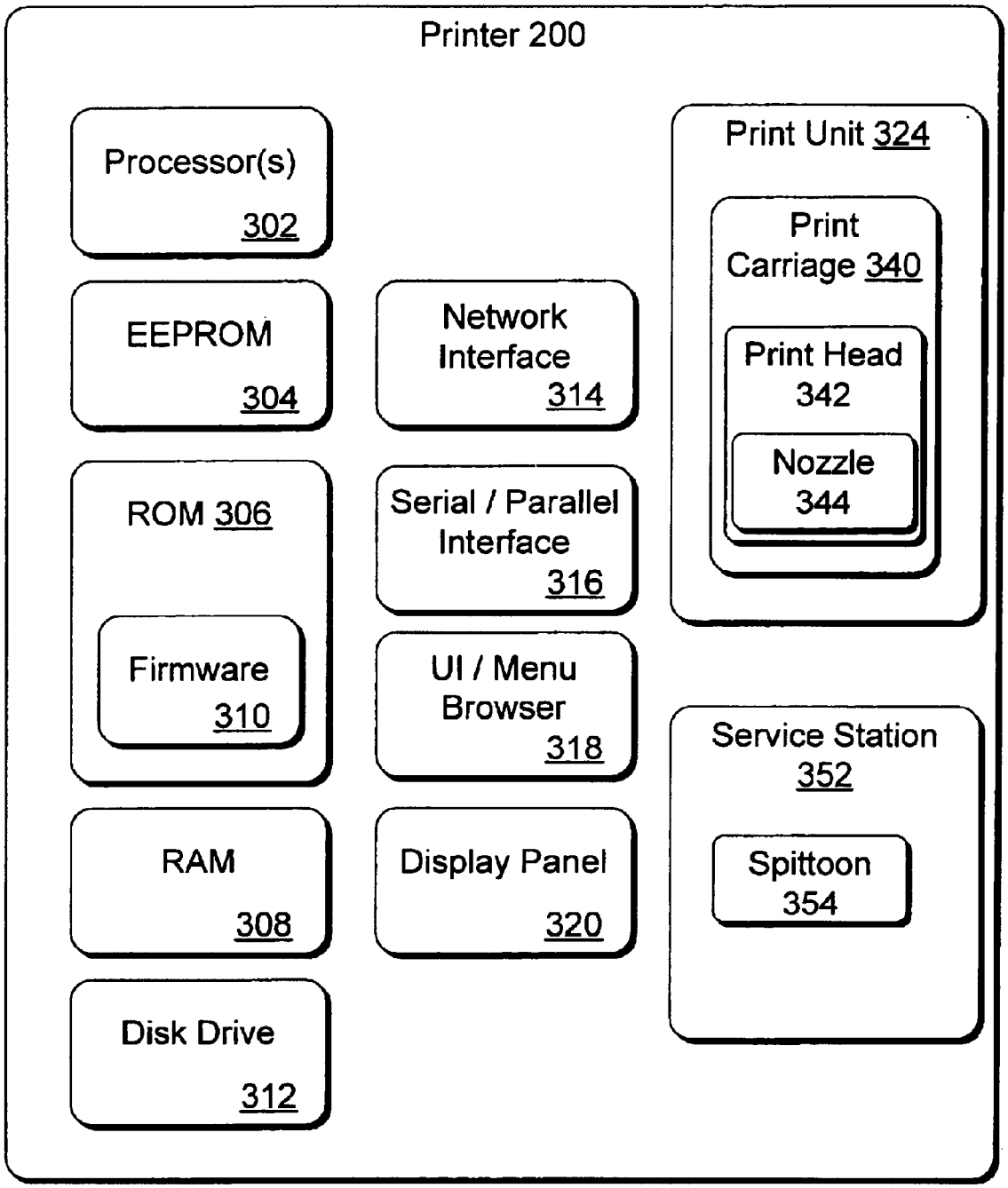
FIG. 3 is a block diagram that illustrates various components of an ink jet printer.

FIG. 3 illustrates various components of printer 200 in a little more detail. Printer 200 can include one or more processors 302 to control various printer operations, such as media handling and carriage movement for linear positioning of the print head over a print media (e.g., paper, transparency, etc.). In some embodiments, the print heads can remain in a fixed position and are arrayed to achieve a desired ink coverage. This can typically be the case in industrial or commercial printing scenarios.

Printer 200 can have an electrically erasable programmable read-only memory (EEPROM) 304, ROM 306 (non-erasable), and a random access memory (RAM) 308. Although printer 200 is illustrated having an EEPROM 304 and ROM 306, a particular printer may only include one of the memory components. Additionally, although not shown, a system bus typically connects the various components within the printer 200.

The printer 200 can also have a firmware component 310 that is implemented as a permanent memory module stored on ROM 306. The firmware 310 is programmed and tested like software, and is distributed with the printer 200. The firmware 310 can be implemented to coordinate operations of the hardware within printer 200 and contains programming constructs used to perform such operations.

Processor(s) 302 process various instructions to control the operation of the printer 200 and to communicate with other electronic and computing devices. The memory components, EEPROM 304, ROM 306, and RAM 308, store various information and/or data such as configuration information, fonts, templates, data being printed, and menu structure information. Although not shown, a particular printer can also include a flash memory device in place of or in addition to EEPROM 304 and ROM 306.

Printer 200 can also include a disk drive 312, a network interface 314, and a serial/parallel interface 316. Disk drive 312 provides additional storage for data being printed or other information maintained by the printer 200. Although printer 200 is illustrated having both RAM 308 and a disk drive 312, a particular printer may include either RAM 308 or disk drive 312, depending on the storage needs of the printer. For example, an inexpensive printer may include a small amount of RAM 308 and no disk drive 312, thereby reducing the manufacturing cost of the printer.

Network interface 314 provides a connection between printer 200 and a data communication network. The network interface 314 allows devices coupled to a common data communication network to send print jobs, menu data, and other information to printer 200 via the network. Similarly, serial/parallel interface 316 provides a data communication path directly between printer 200 and another electronic or computing device. Although printer 200 is illustrated having a network interface 314 and serial/parallel interface 316, a particular printer may only include one interface component.

Printer 200 can also include a user interface and menu browser 318, and a display panel 320. The user interface and menu browser 318 allows a user of the printer 200 to navigate the printer's menu structure. User interface 318 can be indicators or a series of buttons, switches, or other selectable controls that are manipulated by a user of the printer. Display panel 320 is a graphical display that provides information regarding the status of the printer 200 and the current options available to a user through the menu structure.

Printer 200 also includes a print unit 324 that includes mechanisms arranged to selectively apply ink (e.g., liquid ink) to a print media such as paper, plastic, fabric, and the like in accordance with print data corresponding to a print job.

Print unit 324 can comprise a print carriage 340, one or more print heads 342, and one or more print nozzles 344. A service station 352 can include a spittoon 354 for allowing ink to be cleared from the ink nozzles to prevent clogging. In some industrial or commercial applications, the print heads are fixed in a stall.

The print head 342 usually has multiple nozzles 344 that are fired individually to deposit drops of ink onto the print media according to data that is received from the processor 302. As an example, the print head might have nozzles that number into the hundreds. A "firing" is the action of applying a firing pulse or driving voltage to an individual nozzle to cause that nozzle to eject an ink drop or droplet. The firing can be controlled by the processor 302.

For additional background information on ink jet printing systems, the reader is referred to the following patents which are assigned to the assignee of this document and are incorporated by reference herein: (1) for ink jet operation: U.S. Pat. Nos. 6,386,667, 6,390,600, 6,378,985, and 6,155,680; (2) for an ink jet heater/blower system: U.S. Pat. No. 6,059,406; and (3) for ink jet nozzle assemblies or pens: U.S. Pat. Nos. 6,312,117, 6,273,562, and 5,870,125.

Exemplary Embodiment

Figure 1:
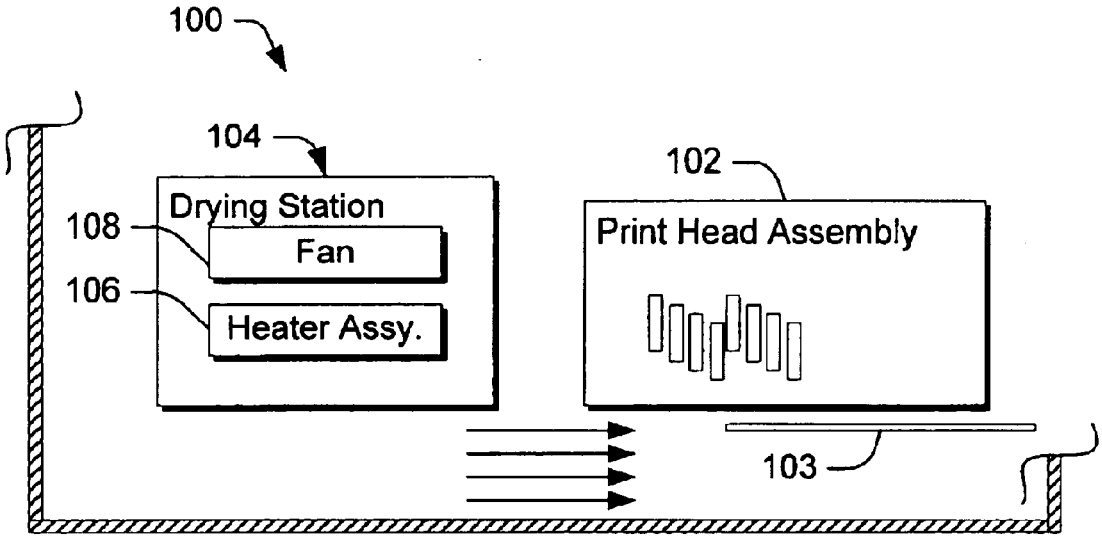
FIG. 1 is a diagram that illustrates an ink jet printing system.
Figure 4:
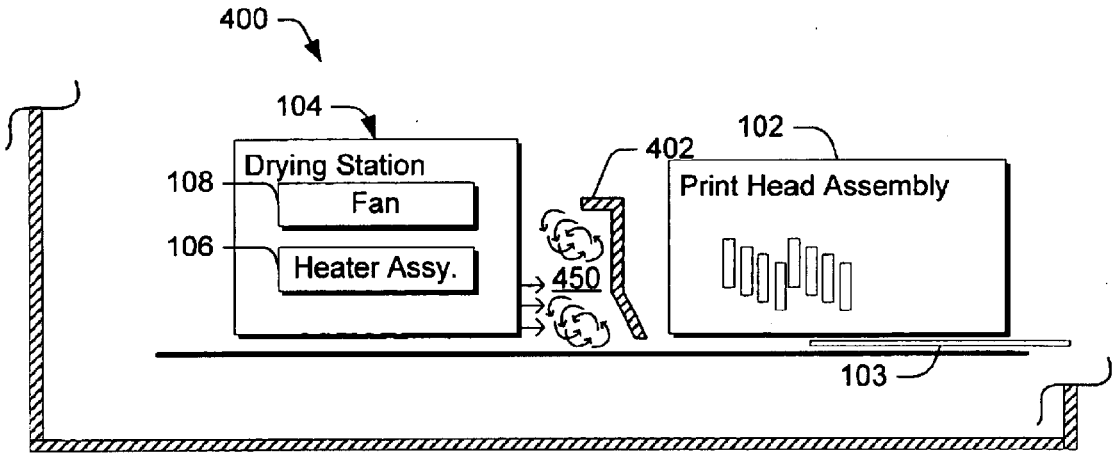
FIG. 4 illustrates an exemplary ink jet printer in accordance with one embodiment.

FIG. 4 shows an exemplary ink jet printing system in accordance with one embodiment, generally at 400. Like numerals from the FIG. 1 system are utilized to indicate like elements, with differences being indicated by use of the "4XX" series numerals.

System 400 comprises a print head assembly 102 which can include a number of different nozzles for selectively applying ink to a print media such as a piece of paper 103. Paper is advanced into the region in which the print head assembly resides, has ink applied to it, and is then moved towards a drying station generally indicated at 104 and downstream of the print head assembly. The drying station typically includes a heater assembly 106 that includes one or more heat sources, and one or more fans 108 to direct heated air in the direction of the paper to facilitate the ink drying process.

In accordance with one embodiment, a deflector 402 is provided and is positioned or mounted intermediate print head assembly 102 and drying station 104. In the illustrated and described embodiment, deflector 402 functions to deflect air that is emitted from the drying station and reduces the amount of the air reaching the region in which the print head assembly is located. This is desirable for a number of different reasons.

First, by deflecting an amount of the air that is emitted from the drying station, the aerosol effect that previously occurred proximate a print media is reduced. As a result, the quality of the print jobs is increased. Second, when such air is heated, by reducing the amount of heated air entering the region occupied by the print head assembly, the lifetime and performance of the print head assembly is enhanced. Specifically, within a typical ink jet printer, the temperature of the print head assembly is monitored. If the print head assembly is determined to be operating at an undesirably high temperature, then the print head assembly can be temporarily disabled until the temperature returns to a more desirable temperature. Over time, prolonged exposure to elevated temperatures can reduce the lifetime of the print head assembly or pens. Disabling the print head assembly can, to say the least, disrupt a user's printing activities. Thus, it is desirable to avoid inconveniencing the user while, at the same time, ensuring that the print head assembly operates within a desired temperature range. By placing deflector 402 intermediate the print head assembly 102 and the drying station 104, the effects of the air, whether heated or not, emanating from the drying station can be mitigated.

Another benefit of deflecting heated air that emanates from the drying station is that the heated air tends to collect in a region 450 on a side of the deflector nearest the drying station. Region 450 can then serve as an intermediate drying station upstream of drying station 104. That is, as the wetted print media moves from the region occupied by the print head assembly 102 to within region 450, the heated air within that region can begin to facilitate the drying process. Accordingly, as the print media advances into the region occupied by the drying station, the action of the fan 108 and heater assembly 106 can be used to advance the drying process.

Any suitable deflector configuration and any suitable materials can be used to form the deflector. In accordance with one embodiment, a metal material such as aluminum can be used to form a suitable deflector. Other materials such as plastics and the like can be used as well.

Figure 5:
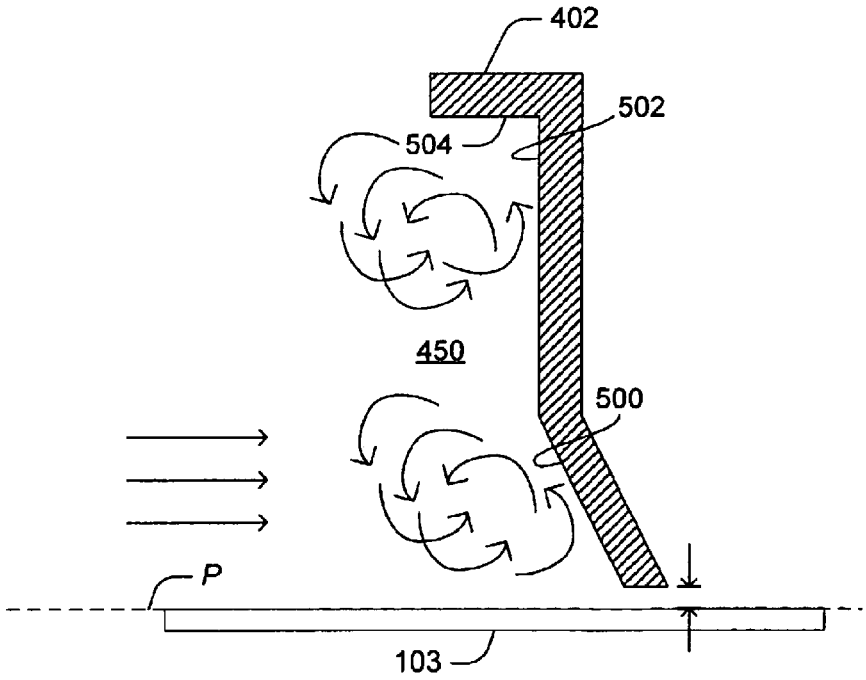
FIG. 5 illustrates an exemplary deflector in accordance with one embodiment.

FIG. 5 shows an enlarged view of deflector 402. In this embodiment, deflector 402 comprises an assembly of sidewalls that are arranged to promote the collection of heated air within region 450. In this particular example, the assembly of sidewalls comprises a first sidewall 500, a second sidewall 502, and a third sidewall 504. In the illustrated and described embodiment, the bottommost portion of sidewall 500 defines a narrow gap between itself and the print media. The dimensions of the gap can vary, although it is advantageous to select the gap dimension such that the print media is ensured of passing under sidewall 500 without being disturbed in its path. In one embodiment, suitable dimensions of the gap can be such that the gap is no greater than about 10 millimeters. In another embodiment, the gap can range in dimensions from between about 1½ to 10 millimeters. In yet another more desirable embodiment, the gap can range in dimensions from between about 1½ to 2 millimeters.

In this example, sidewall 500 is oriented so that it is generally oblique relative to a plane P that is defined by a print media that passes underneath the deflector. Sidewall 502 is joined with sidewall 500 and is oriented so that it is generally orthogonal relative to plane P. Sidewall 504 is joined with sidewall 502 and is oriented so that it is generally parallel to plane P. Sidewall 504 forms, together with sidewall 502, a shelf that extends away from print head assembly 102 and towards drying station 104. The effect of the shelf is to interact with the heated air as it rises and swirls, and to cause the heated air to collect in region 450. As a result, when the wetted print media 103 moves through region 450, the collected heated air can begin the ink-drying process.

In some embodiments, the width of the deflector 402 (into and out of the plane of the page upon which FIG. 5 appears), can be the same as, or of comparable dimensions to the widest width of print media that the ink jet printer is to process. That way, the deflector can extend along the entirety of the paper width as it passes through region 450. This can promote uniform drying of the ink on the print media.

Advantageously, in some embodiments, the deflector can be permanently, immovably fixed within the ink jet printer. This can avoid having additional moving parts which can increase the likelihood of failure. Any suitable mechanism can be used to mount or otherwise fix the deflector within the ink jet printer. For example, the deflector can be screwed to, or otherwise permanently mechanically fixed in place with any suitable fastening mechanism.

Exemplary Method

Figure 6:
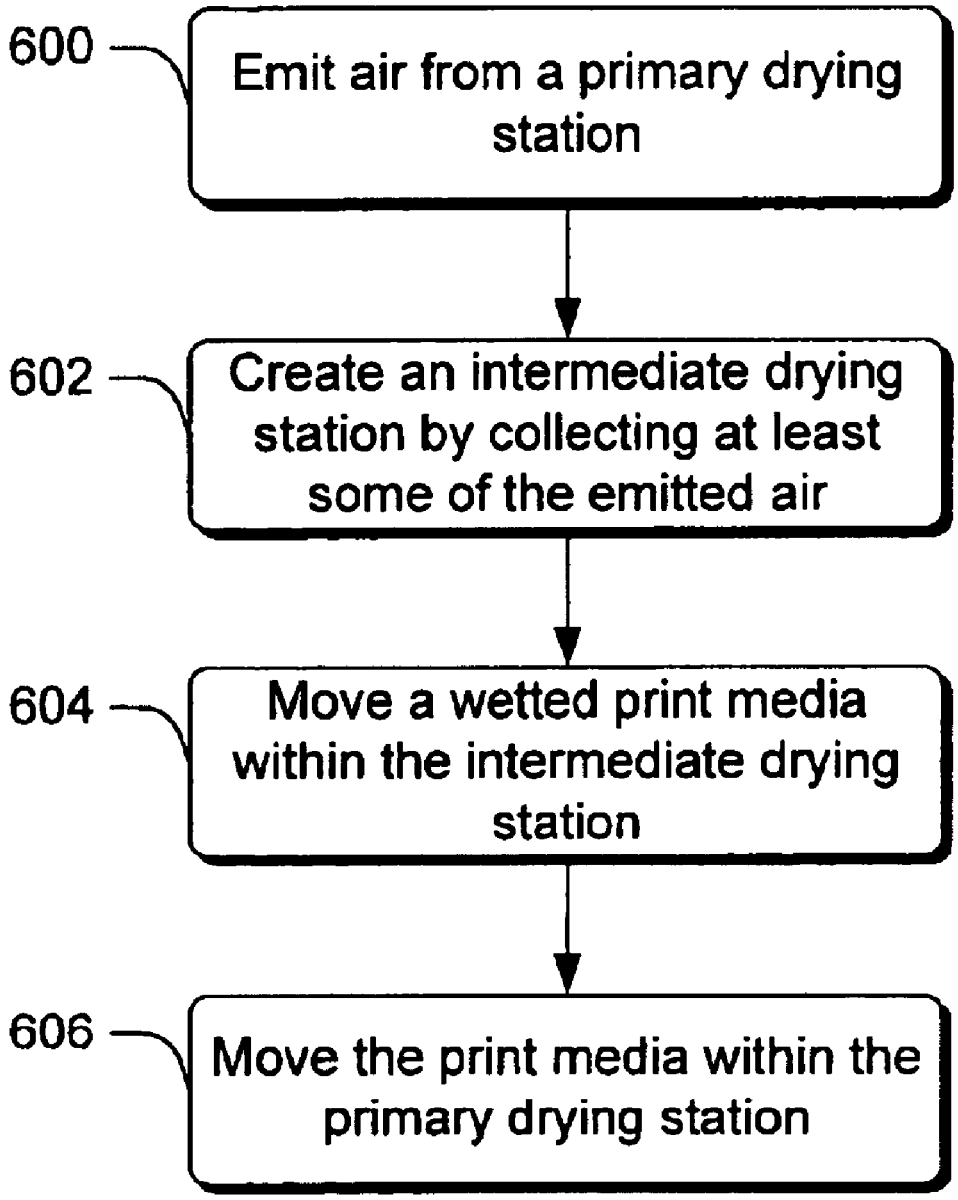
FIG. 6 is a flow diagram that describes steps in a method in accordance with one embodiment.

FIG. 6 is a flow diagram that describes steps in a method in accordance with one embodiment. The method can be implemented in connection with any suitable ink jet printing device. Examples of such ink jet printing devices are given above.

Step 600 emits air from a primary drying station. In the illustrated and described embodiment, the air that is emitted from the drying station comprises remnant heated air that is utilized by the primary drying station to dry a wetted print media. It is to be appreciated, however, that such air need not be heated. An exemplary primary drying station 104 is shown and described above in connection with FIG. 4. Step 602 creates an intermediate drying station by collecting at least some of the emitted air. The air can be collected by interposing a deflector in the path that the air typically wants to take between the drying station and the print head assembly. The result of the interposition of the deflector is that at least a portion, or possibly a majority, of the air that previously (i.e. in the absence of the deflector) migrated into the region occupied by the print head assembly is now diverted in a manner that defines the intermediate drying station.

Any suitable deflector structure can be utilized to collect the air. For example, the deflector can be provided as a permanently fixed, generally planar sidewall. Alternately or additionally, an assembly of sidewalls can be provided to facilitate air collection. In the FIG. 5 example, a sidewall assembly comprising three differently-oriented sidewalls is utilized. Other configurations can, of course, be utilized without departing from the spirit and scope of the claimed subject matter.

Step 604 moves a wetted print media within the intermediate drying station. This preliminarily begins to dry the ink upon the print media. The drying action can take place by one or more of the action of the air within the intermediate drying station and, when heated, the action of the heated air within the intermediate drying station. Step 606 moves the print media within the primary drying station. This continues and ultimately brings to conclusion the ink jet printer's drying process.

Conclusion

Various ink jet printing systems are described. The systems comprise a deflector that is mounted between a printer's print head assembly and its drying station. The deflector functions to deflect a desirable amount of the air that is produced at the drying station from reaching print head assembly. Accordingly, the deflector helps to reduce ink aerosol that was produced by air that formerly migrated into the region of the printer occupied by the print head assembly. Additionally, deflection of the air creates an intermediate drying region or station outside of the primary drying station. The intermediate drying station can facilitate the ink drying process by using air that is collected from the primary drying station to preliminarily begin drying the ink. Additionally, advantages are achieved in the area of print head performance and lifetime by deflecting, when the air is heated, a desirable amount of heated air that previously adversely impacted print head performance.

Although the disclosure has been described in language specific to structural features and/or methodological steps, it is to be understood that the appended claims are not limited to the specific features or steps described. Rather, the specific features and steps are exemplary forms of implementing this disclosure.

What is claimed is:

1. A system comprising:

a print head assembly comprising a plurality of ink-ejecting nozzles;

a drying station downstream of the print head assembly and configured to produce and emit heated air proximate a print media; and a deflector mounted between the print head assembly and the drying station and configured to deflect an amount of the air produced by the drying station, wherein the deflector is configured to deflect and collect the heated air adjacent the deflector and the print media to create an intermediate drying station outside of the drying station, the intermediate drying station being positioned to be encountered by at least a portion of the print media before said portion encounters the drying station, wherein the deflector is configured to cause air emitted from the drying station to swirl adjacent to the deflector and along the print media.

2. The system of claim 1, wherein the intermediate drying station is located on a side of the deflector nearest the drying station.

3. The system of claim 1, wherein the deflector comprises a metal material.

4. The system of claim 1, wherein the deflector comprises an assembly of sidewalls that are arranged to promote air collection.

5. The system of claim 1, wherein the deflector comprises an assembly of sidewalls that are arranged to promote air collection, one or more of the sidewalls configured to extend substantially parallel to the print media and to collect the heated air.

6. The system of claim 1, wherein the deflector is immovably fixed within an ink jet printing system.

7. The system of claim 1, wherein the drying station is configured to produce and emit heated air.

8. The system of claim 1, wherein the intermediate drying station is configured to form a region of above ambient air pressure along the deflector and adjacent the print media at the intermediate drying station.

9. The system of claim 1, wherein the deflector includes an end along a gap through which the print media passes and a face extending along the end and configured to face the print media so as to deflect heated air towards the print media.

10. The system of claim 9, wherein the deflector includes a sidewall configured to extend substantially parallel to the print media.

11. A system comprising:

a print head assembly comprising a plurality of ink-ejecting nozzles;

a primary drying station downstream of the print head assembly, the primary drying station comprising one or more heat sources to produce heated air, and one or more fans to direct the heated air towards a wetted print media; and an intermediate drying station upstream of the primary drying station, the intermediate drying station comprising a plurality of sidewalls positioned to deflect the heated air to promote collection of the heated air and to cause the heated air to swirl adjacent the print media to facilitate drying the wetted print media.

12. The system of claim 11, wherein one of the sidewalls comprises a sidewall portion that defines a gap relative to a print media that passes thereunder, the gap being from between about 1½ to 10 millimeters.

13. The system of claim 11, wherein one of the sidewalls comprises a sidewall portion that defines a gap relative to a print media that passes thereunder, the gap being from between about 1½ to 2 millimeters.

14. The system of claim 11, wherein one of the sidewalls comprises a sidewall portion that defines a gap relative to a print media that passes thereunder, the gap being no greater than about 10 millimeters.

15. The system of claim 11, wherein one of the sidewalls is oriented so that it is generally oblique relative to a plane that is defined by a print media that passes underneath.

16. The system of claim 11, wherein one of the sidewalls is oriented so that it is generally orthogonal relative to a plane that is defined by a print media that passes underneath.

17. The system of claim 11, wherein one of the sidewalls is oriented so that it is generally parallel relative to a plane that is defined by a print media that passes underneath.

18. A system comprising:

a print head assembly comprising a plurality of ink-ejecting nozzles;

a primary drying station downstream of the print head assembly, the primary drying station comprising one or more heat sources to produce heated air; and one or more fans to direct the heated air towards a wetted print media;

an intermediate drying station upstream of the primary drying station, the intermediate drying station comprising a sidewall assembly positioned to promote collection of heated air that is emitted from the primary drying station, the sidewall assembly comprising:

at least one sidewall having an end closest to a print media extending a plane that passes underneath, the at least one sidewall having a face extending along the end oblique to the plane and facing the print media to deflect the heated air toward the print media;

at least one sidewall that is oriented so that it is generally orthogonal relative to a plane that is defined by a print media that passes underneath; and at least one sidewall that is oriented so that it is generally parallel relative to a plane that is defined by a print media that passes underneath.

19. The system of claim 18, wherein the sidewall assembly comprises a portion that defines a gap relative to a print media that passes thereunder, the gap being from between about 1½ to 10 millimeters.

20. The system of claim 18, wherein the sidewall assembly comprises a portion that defines a gap relative to a print media that passes thereunder, the gap being from between about 1½ to 2 millimeters.

21. The system of claim 18, wherein the sidewall assembly comprises a portion that defines a gap relative to a print media that passes thereunder, the gap being no greater than about 10 millimeters.

22. An apparatus comprising:

a deflector of an intermediate drying station configured to be mounted between a print head assembly and a drying station of an ink jet printer, the deflector comprising:

a sidewall assembly that is positionable within the ink jet printer to promote collection of air that is emitted from the drying station;

the sidewall assembly including an end configured to extend closest to print media extending in a plane which, when positioned within an ink jet printer, defines a gap relative to the print media that passes thereunder, the gap being no greater than about 10 millimeters and a face extending along the end oblique to the plane and configured to face the print media to deflect air emitted by the drying station towards the print media.

23. The apparatus of claim 22, wherein the gap is from between about 1½ to 10 millimeters.

24. The apparatus of claim 22, wherein the gap being from between about 1½ to 2 millimeters.

25. The apparatus of claim 22, wherein the sidewall assembly comprises at least one sidewall that is oriented so that it is generally orthogonal relative to a plane that is defined by a print media that passes underneath.

26. The apparatus of claim 22, wherein the sidewall assembly comprises at least one sidewall that is oriented so that it is generally parallel relative to a plane that is defined by a print media that passes underneath.

27. The apparatus of claim 22, wherein the sidewall assembly comprises at least one sidewall that is oriented so that it is generally oblique relative to a plane that is defined by a print media that passes underneath, at least one sidewall that is oriented so that it is generally orthogonal relative to a plane that is defined by a print media that passes underneath, and at least one sidewall that is oriented so that it is generally parallel relative to a plane that is defined by a print media that passes underneath.

28. An apparatus comprising:

means for emitting air from a primary drying station within an ink jet printer; and means, outside of the primary drying station, for creating an intermediate drying station by deflecting and collecting at least some of the emitted air from the primary drying station and maintaining collected air along a print media to form a region of above ambient air pressure along the deflector means and adjacent the print media.

29. The apparatus of claim 28, wherein said means for creating an intermediate drying station is immovably fixed within the ink jet printer.

30. The apparatus of claim 28, wherein said means for creating an intermediate drying station is immovably fixed within the ink jet printer between the primary drying station and a print head assembly.

31. The apparatus of claim 28, wherein said means for creating an intermediate drying station comprises an aluminum structure.

32. The apparatus of claim 28, wherein said means for creating an intermediate drying station comprises a shelf for interacting with the air emitted from the primary drying station.

33. A method comprising:

emitting air from a primary drying station within an ink jet printer;

creating an intermediate drying station by restricting flow of the emitted air away from a print media and deflecting air towards the print media using a deflector having an end configured to extend closest to print media extending in a plane and a face extending alone the end oblique to the plane and facing the media, wherein the deflector is interposed between the primary drying station and a print head assembly of the ink jet printer;

moving a wetted print media within the intermediate drying station; and moving the print media within the primary drying station.

34. The method of claim 33, wherein the act of emitting is performed by emitting heated air from the primary drying station.

35. The method of claim 33, wherein the act of creating is performed by interposing a deflector that is immovably fixed within the ink jet printer.

36. The method of claim 33, wherein the act of creating is performed by interposing a deflector comprising a sidewall assembly, the sidewall assembly comprising a portion which defines a gap relative to a print media that passes thereunder, the gap being no greater than about 10 millimeters.

37. The method of claim 33, wherein the act of creating is performed by interposing a deflector comprising a sidewall assembly, the sidewall assembly comprising a portion which defines a gap relative to a print media that passes thereunder, the gap being from between about 1½ to 10 millimeters.

38. The method of claim 33, wherein the act of creating is performed by interposing a deflector comprising a sidewall assembly, the sidewall assembly comprising a portion which defines a gap relative to a print media that passes thereunder, the gap being from between about 1½ to 2 millimeters.

39. The method of claim 33, wherein the act of creating is performed by interposing a deflector comprising a sidewall assembly, the sidewall assembly comprising a portion which defines a gap relative to a print media that passes thereunder, the gap being no greater than about 10 millimeters, the sidewall assembly comprising at least one sidewall that is oriented so that it is generally oblique relative to a plane that is defined by a print media that passes underneath.

40. The method of claim 33, wherein the act of creating is performed by interposing a deflector comprising a sidewall assembly, the sidewall assembly comprising a portion which defines a gap relative to a print media that passes thereunder, the gap being no greater than about 10 millimeters, the sidewall assembly comprising at least one sidewall that is oriented so that it is generally orthogonal relative to a plane that is defined by a print media that passes underneath.

41. The method of claim 33, wherein the act of creating is performed by interposing a deflector comprising a sidewall assembly, the sidewall assembly comprising a portion which defines a gap relative to a print media that passes thereunder, the gap being no greater than about 10 millimeters, the sidewall assembly comprising at least one sidewall that is oriented so that it is generally parallel relative to a plane that is defined by a print media that passes underneath.

42. The method of claim 33, wherein the act of creating is performed by interposing a deflector comprising a sidewall assembly, the sidewall assembly comprising a portion which defines a gap relative to a print media that passes thereunder, the gap being no greater than about 10 millimeters, the sidewall assembly comprising at least one sidewall that is oriented so that it is generally oblique relative to a plane that is defined by a print media that passes underneath, at least one sidewall that is oriented so that it is generally orthogonal relative to a plane that is defined by a print media that passes underneath, and at least one sidewall that is oriented so that it is generally parallel relative to a plane that is defined by a print media that passes underneath.

43. A system comprising:

fluid ejecting nozzles;

a fan; and a deflector between the nozzles and the fan and configured to cooperate to restrict air flow away from a print media to form a region of greater than ambient air pressure adjacent the deflector and adjacent the print media.

44. A system for depositing fluid upon a print media, the system comprising:

fluid ejecting nozzles;

a drying station configured to direct heated air proximate the print media; and a deflector between the nozzles and the drying station, wherein the deflector includes a portion configured to extend non-perpendicular to the print media, the portion being spaced from the drying station by a horizontal opening bounded by the portion and the drying station, wherein the driving station and the deflector are not interconnected.

45. The system of claim 44, wherein the portion is configured to extend substantially parallel to the print media.

46. A system for depositing fluid upon a print media, the system comprising:

fluid ejecting nozzles;

a drying station configured to direct heated air proximate the print media; and a deflector between the nozzles and the drying station, wherein the deflector includes a portion configured to extend non-perpendicular to the print media, the portion being spaced from the drying station by a horizontal opening bounded by the portion and the drying station, wherein the portion is configured to extend substantially parallel to the print media.

47. A system comprising:

a print head assembly comprising a plurality of ink-ejecting nozzles;

a drying station downstream of the print head assembly and configured to produce and emit heated air proximate a print media; and a deflector mounted between the print head assembly and the drying station and configured to deflect an amount of the air produced by the drying station, wherein the deflector is configured to deflect and collect the heated air adjacent the deflector and the print media to create an intermediate drying station outside of the drying station, the intermediate drying station being positioned to be encountered by at least a portion of the print media before said portion encounters the drying station, wherein the intermediate drying station is configured to form a region of above ambient air pressure along the deflector and adjacent the print media at the intermediate drying station.

* * * * *